US006273414B1

(12) United States Patent
Matsuo

(10) Patent No.: US 6,273,414 B1
(45) **Date of Patent: *Aug. 14, 2001**

(54) SHEET FEEDING APPARATUS AND IMAGE FORMING APPARATUS

(75) Inventor: Kazuhiro Matsuo, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/958,525

(22) Filed: Oct. 27, 1997

(30) Foreign Application Priority Data

Oct. 30, 1996 (JP) ..... 8-287764

(51) Int. Cl.[7] ..... B65H 3/44; B65H 5/26
(52) U.S. Cl. ..... 271/9.11; 271/9.13
(58) Field of Search ..... 271/9.01, 9.11, 271/9.13, 2; 399/391

(56) References Cited

U.S. PATENT DOCUMENTS 4,985,736 * 1/1991 Kawano et al. .
5,102,112 * 4/1992 Takahashi ..... 271/9.11
5,168,316 * 12/1992 Hino et al. ..... 271/9.03
5,485,990 * 1/1996 Kato ..... 271/9.11
5,501,444 * 3/1996 Yukimachi et al. ..... 271/9.11
5,512,928 * 4/1996 Kato et al. ..... 271/9.01
5,565,970 * 10/1996 Suda ..... 271/9.01
5,803,632 * 9/1998 Grossman ..... 271/2

FOREIGN PATENT DOCUMENTS

360223739 * 11/1985 (JP) ..... 271/9.13
361243751 * 10/1986 (JP) ..... 271/9.13
406001488 * 1/1994 (JP) ..... 271/9.13

* cited by examiner

*Primary Examiner*—H. Grant Skaggs
(74) *Attorney, Agent, or Firm*—Fitzpatrick, Cella, Harper & Scinto

(57) ABSTRACT

A sheet feeding apparatus has a plurality of sheet containers, a plurality of sheet feeding units and a plurality of curving conveying routes for guiding the sheets to a common conveying route. One of the sheet containers is adapted to hold envelopes and other sheets of high rigidity, and the sheet feeding apparatus is constructed such that a radius of curvature of the curving conveying route for the envelope and other sheets of high rigidity is made larger than a radius of curvature of a second curving portion of another conveying route.

9 Claims, 5 Drawing Sheets

SHEET FEEDING APPARATUS AND IMAGE FORMING APPARATUS

BACKGROUND OF THE INVENTION

1. Field of the Invention

This invention relates to a sheet feeding apparatus mounted in an image forming apparatus such as a photocopier, a printer, and the like.

2. Description of Related Art

As an image forming apparatus such as a photocopier, a printer, etc., a mechanism has been proposed in which a sheet feeding means is set in containing multiple sheets to automatically feed the sheets and after a pickup roller takes up the sheets, a feed roller and a retard roller cooperate to convey the sheets one by one to form images. Another known apparatus conveys sheets fed manually one by one to form images, in order for feeding differently sized sheets and special sheets such as thick papers and envelops.

To render such an image forming apparatus smaller, a conveying means for conveying sheets that are fed from a sheet containing means is also made smaller, and thereby, the radius of curvature of a curving portion in a conveying route is made relatively small as to be capable of conveying merely the regular cut sheets that are ordinarily used. With such a conventional art, however, when automatically feeding a special sheet such as a rigid thick sheet or envelop, the apparatus cannot feed the sheet along a sheet guide forming a curving portion due to a small radius of curvature at the curving portion in the conveying route, thereby raising a problem that the apparatus fails to stably feed sheets upon occurrence of paper jams or conveyance defects.

SUMMARY OF THE INVENTION

This invention solves the above problem. It is an object of the invention to provide a sheet feeding apparatus capable of sufficiently feeding rigid sheets such as thick papers and special sheets such as envelops and to provide an image forming apparatus in which this sheet feeding apparatus is mounted.

A representative constitution of the invention to achieve the foregoing object is a sheet feeding apparatus including a plurality of sheet containing means for containing sheets, a plurality of sheet feeding means for feeding respective sheets contained at the sheet containing means, and a plurality of conveying routes for merging respective sheets fed by the respective sheet feeding means into a common conveying route, wherein a radius of curvature of a first curving portion where at least one conveying route among the plural conveying routes merges into the common conveying route is larger than a radius of curvature of a second curving portion where other conveying routes merge into the common conveying route.

The invention, since thus constructed, allows rigid sheets such as thick papers or special sheets such as envelops to pass the first curving portion at which the radius of curvature is relatively large and to be introduced into the common conveying route, thereby being capable of adequately feeding rigid sheets such as thick papers or special sheets such as envelops.

DETAILED DESCRIPTION OF THE PREFERRED EMBODIMENTS

Figure 1:
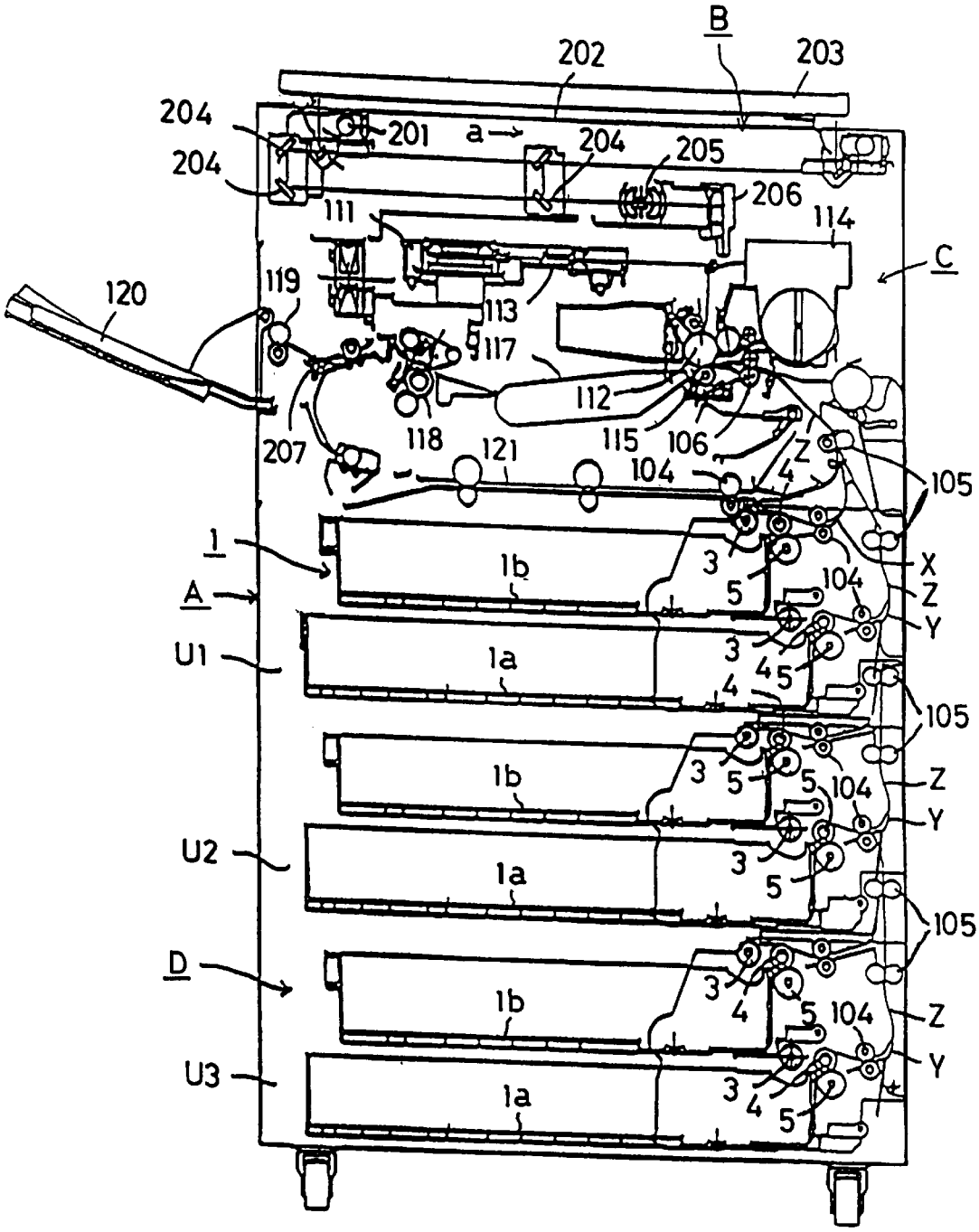
FIG. 1 is a cross-sectional illustration showing a structure of an image forming apparatus having a sheet feeding apparatus according to the invention.

Referring to the drawings, an embodiment in which the invention applies to a photocopier as an example of an image forming apparatus having a sheet feeding apparatus according to the invention will be described.

First, referring to FIG. 1, the entire constitution of an image forming apparatus having a sheet feeding apparatus according to the invention is described. In FIG. 1, an image forming apparatus body A includes a scanner unit B mounted at an upper portion of the body serving as an image reading means for reading image information on image surfaces on originals in a form of books or the like, an image forming unit C placed below the scanner unit B, and a sheet deck D built-in below the image forming unit C for containing sheets S made of paper, synthetic resin, or the like.

The scanner unit B includes a scanning light source 201, a platen glass 202, an original pressure plate 203 capable of opening and shutting to the apparatus body A, a mirror 204, lens 205, a photo receiver (photo-electric conversion element) 206, an image processing unit or the like.

Originals such as originals in a form of books including thick paper, curling paper, etc., and originals in a form of sheets are put on the platen glass 202 in a manner that the original surface faces down. A back of the original is pushed by the original pressure plate 203 to make the original immovable. Upon pushing a start key, the scanning light source 201 scans in a direction of arrow a in FIG. 1 at a bottom of the platen glass 202 to read image information on the original surface. The image information of the original read by the scanning light source 201 is processed at the image processing unit and transmitted to a laser scanner 111 upon converted to an electrical signal.

The image forming apparatus A here functions as a photocopier when the laser scanner 111 inputs the processed signal from the image processing unit and as a printer when the scanner inputs an output signal from a personal computer. The apparatus A also functions as a facsimile machine when inputting a transmission signal from another facsimile machine or when transmitting the processed signal at the image processing unit to another facsimile machine.

A sheet cassette 1 serving as a sheet containing means is attached below the image forming unit C. In this sheet cassette 1, a lower cassette 1*a* and an upper cassette 1*b* constitute a feeding unit. In this embodiment, as shown in FIG. 1, three feeding units U1, U2, U3 are attached to render six cassettes attached.

The feeding unit U1 placed at an upper position is detachably attached to the apparatus body A while other two lower feeding units U2, U3 are detachably attached to the sheet deck D. Each upper cassette 1*b* of the feeding units U1, U2, U3 is capable of containing and feeding relatively inflexible sheets such as thick paper or special sheets such as envelops. A sheet S fed from the upper cassette 1*b* is conveyed to be introduced into a common conveying route Z vertically extending in the image forming apparatus body A by way of a conveying path X having a relatively large radius of curvature.

The sheets S made of paper or synthetic resin contained in the upper and lower cassettes 1*a*, 1*b* are taken up by a pickup roller 3 serving as a sheet feeding means as described in detail below. After the sheets S are separated and fed one by one by cooperation of a feed roller 4 and a retard roller the sheets S are then carried by a conveying roller 104 to pass a plurality of conveying paths, namely, the conveying path X and a conveying path Y, which are merged into the common conveying route Z. The sheets S are then conveyed by a conveying roller 105 and introduced to a register roller 106, which feeds the sheets S to the image forming unit C in synchronized with image forming operation.

The image forming unit C includes an electrophotographic photosensitive drum 112 serving as an image forming means, an optical system 113 for writing images, a developer 114, a transfer charger 115, and the like. A laser beam corresponding to image information emitted from a laser scanner 111 is scanned by the optical system 113 for writing images to form a latent image on a surface of the photosensitive drum 112 that has uniformly charged by a charger. The developer 114 forms a toner image on the latent image. The toner image is transferred by the transfer charger 115 onto a first side of the sheet S, which is conveyed by the register roller 106 in synchronized with rotation of the photosensitive drum 112.

Numeral 117 denotes a conveyance belt for conveying a sheet S on which a toner image is formed; numeral 118 denotes a fixing apparatus; numeral 119 denotes a delivery roller. The sheet S on which the toner image is formed is conveyed to the fixing apparatus 118 by the conveyance belt 117. After the toner image is fixed on the surface of the sheet S by application of heat and pressure, the delivery roller 119 delivers the sheet S to a sorter 120 mounted outside the apparatus body, and the sorter 120 holds the sheet S thereon.

When the apparatus records images on both sides of the sheets S, the delivery roller 119 cramps the sheet S delivered from the fixing apparatus 118 and rotates in a reverse direction to feed the sheet S at a time that a rear end of the sheet S passes a separation point 207. After put on a double side tray 121 for a moment, the sheet S is conveyed again by the conveying rollers 104, 105 and reaches the register roller 106. The reversed sheet S is delivered and fed to the sorter 120 after images are formed on the second side of the sheet S in the same manner as described above.

Figure 2:
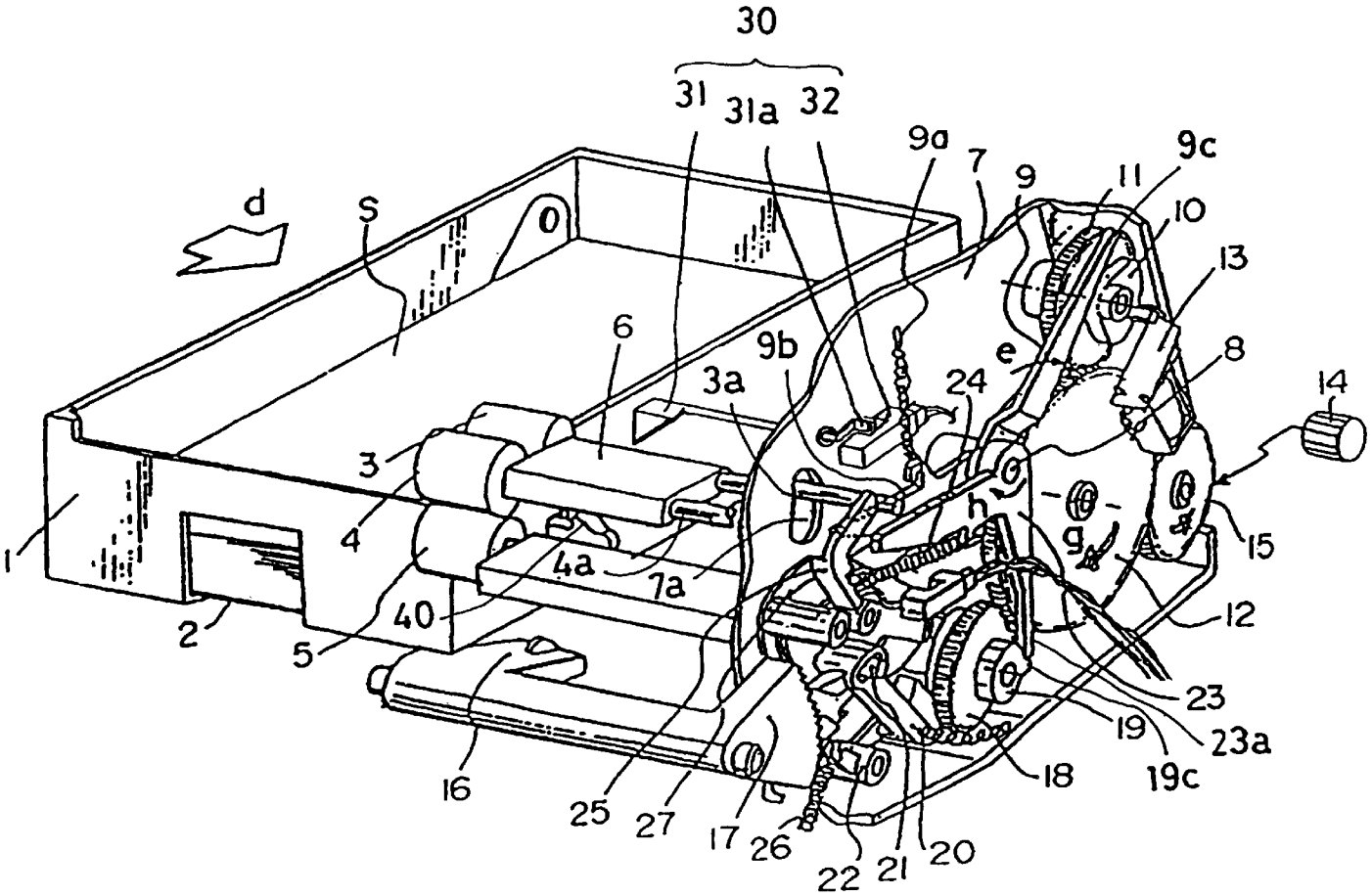
FIG. 2 is a perspective view showing a structure of a feeding unit.
Figure 3:
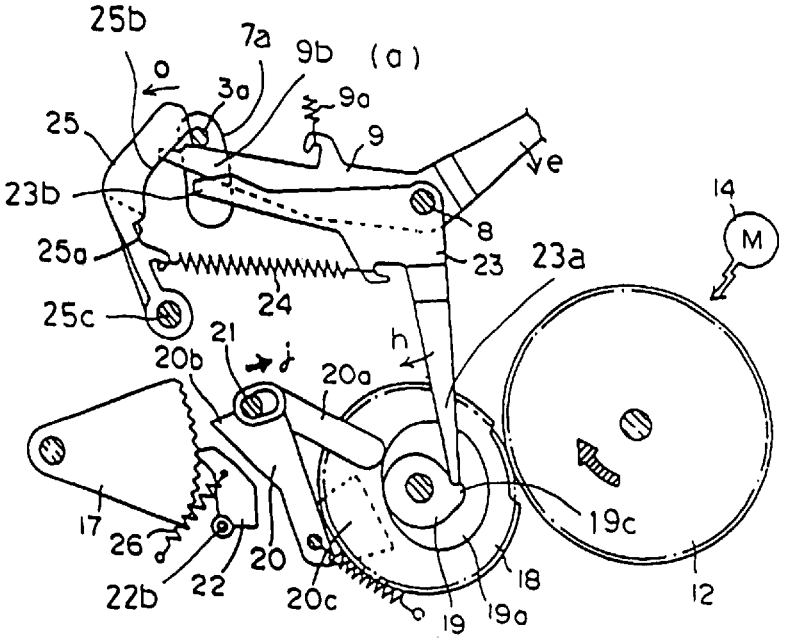
FIGS. 3(*a*), 3(*b*) are cross-sectional illustrations showing a rocking operation of a lifter and a feeding rotary body.
Figure 3:
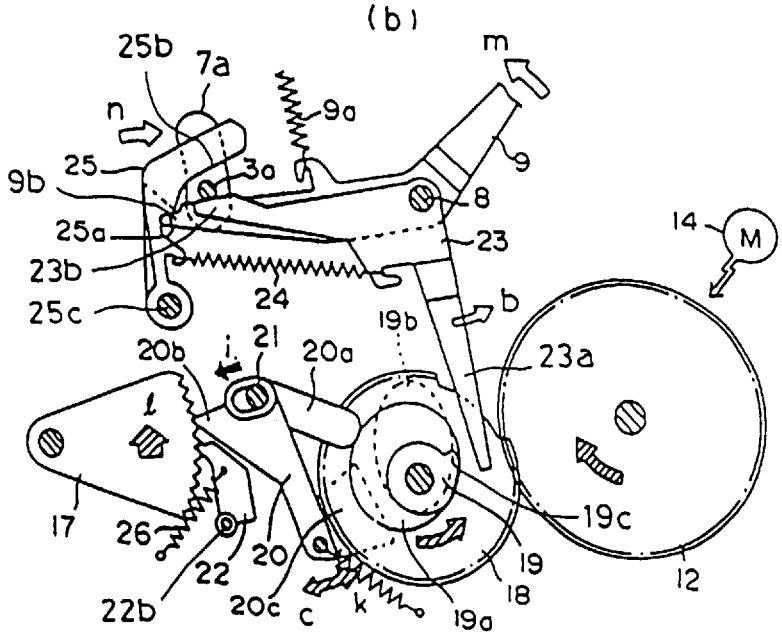

Referring to FIGS. 2, 3(*a*), 3(*b*), mechanisms for the rocking operation of the pickup roller 3 and the moving up and down operation of the lifter are described. FIG. 2 is a perspective view showing a structure of the feeding unit. A sheet mounting plate 2 formed at a bottom of and attached pivotably to the sheet cassette 1 serving as a sheet containing means, holds a sheet S made of a paper, thin synthetic resin plate, or the like on the plate. The sheet cassette 1 is attached to the image forming apparatus body A by pushed in a direction of arrow d in FIG. 2.

The pickup roller 3 serving as a feeding rotary body takes, from the topmost sheet, the sheets S placed on the sheet mounting plate 2 of the sheet cassette 1. The feed roller 4 arranged on a downstream side of the sheet feeding direction (hereinafter simply referred to as "downstream side") of the pickup roller 3, is rotated in the normal direction with respect to the sheet feeding direction, while the retard roller 5 is rotated in the reverse direction with respect to the sheet feeding direction, thereby separating and feeding, sheet by sheet, the sheets S picked up by the pickup roller 3.

As shown in FIG. 2, a pickup roller shaft 3*a* of the pickup roller 3 and a feed roller shaft 4*a* of the feed roller 4 are supported and connected by a roller holder 6 constituting a rocking means for rocking the feeding rotary body. The roller holder 6 is pivotal around the feed roller shaft 4*a* in a range that the pickup roller shaft 3*a* is movable inside a long hole 7*a* formed in a feeding frame 7. The roller holder 6 is normally urged by forcing means such as a spring or the like not shown to push the pickup roller 3 as to give a pressure on the sheets S mounted on the sheet mounting plate 2.

One end of the pickup roller shaft 3*a* penetrates the long hole 7*a* in the feeding frame 7 and extends on a right side of a lifter mechanism shown in FIG. 2. A lift-up lever 9 is attached pivotably with respect to a shaft 8 as center, which is unitedly formed with the feeding frame 7. The lift-up lever 9 is normally urged in a clockwise direction (arrow e direction in FIG. 2) around the shaft 8 by a spring 9*a* engaged to the feeding frame 7 via the end of the spring, thereby rendering a shaft contact piece 9*b*, or one end of the lift-up lever 9, contact with the pickup roller shaft 3*a* from the bottom side of the shaft 3*a*.

A cam contact member 9*c*, the other end of the lift-up lever 9, extends near a pickup cam 10. The cam contact member 9*c* of the lift-up lever 9 is in contact and engagement with the pickup cam 10 by pulling force of the spring 9*a*. The lift-up lever 9 rocks around the shaft 8 upon revolution of the pickup cam 10.

The pickup cam 10 is arranged as opposed to a gear 12 and is formed coaxially and in a united body with a partially toothless pickup gear 11, which lacks tooth in part, on a side face of the gear 11. The pickup gear 11 is normally urged in a counterclockwise direction (arrow f direction in FIG. 2) by an urging means not shown. In this embodiment, rotation of the pickup cam 10 is restricted by a flapper solenoid 13 in opposition to force of the urging means.

Numeral 14 denotes a main motor of the image forming apparatus body A; drive force from the motor 14 is transmitted to the gear 12 by a gear 15, thereby rotating the gear 12 normally in arrow g direction in FIG. 2. In FIG. 2, numeral 30 is a sheet level detector for detecting a surface level of the sheets S mounted on the sheet mounting plate 2. The sheet level detector 30 includes a sheet level detection lever 31 arranged at a position corresponding to the sheet level of sheets S mounted on the sheet mounting plate 2, and a sheet level detection sensor 32 arranged corresponding to a sensor side end 31a of the sheet level detection lever 31.

The sheet level detection lever 31 is supported pivotably with respect to the feeding frame 7. When no sheet S is mounted on the sheet mounting plate 2, or at an initial stage in which the sheet cassette 1 is just attached to the image forming apparatus body A upon putting the sheets S on the sheet mounting plate 2 while the sheet cassette is pulled out of the image forming apparatus body A, the sheet level detection lever 31 is in a down state, and the sensor side end 31*a* of the sheet level detection lever 31 renders the sheet level detection sensor 32 turned off.

If feeding starts while the sheets S are mounted on the sheet mounting plate 2, the sheet mounting plate 2 moves up by operation of a lifter mechanism as described below, and thereby, the sheet surface of the sheets S mounted on the sheet mounting plate 2 pushes up the sheet level detection lever 31 to pivotally move the lever 31.

When the apparatus recognizes that the sheet level reaches a position suitable to start a feeding operation, or that the topmost sheet level of the sheets S reaches a prescribed height, by transition from turned-off to turned-on of the sheet level detection sensor 32 according to a movement of the sensor side end 31*a* of the sheet level detection lever 31, the lifter mechanism stops operation to move up the plate 2, and feeding operation for sheets S starts.

As shown in FIGS. 3(*a*), 3(*b*), a partially toothless lift-up gear 18 is so arranged as to partly mesh the gear 12 and is formed coaxially with a lift-up cam 19, a first cam 19*a*, and a second cam 19*b* juxtaposedly. The first cam 19*a* is rotated by the gear 12 and the lift-up gear (partially toothless gear) 18, thereby rocking a forwarding piece 20, which is arranged near the lift-up gear 18, around a shaft 21 by way of a first cam contact portion 20*a*. A pawl 22 is held pivotably around a shaft 22*b* and normally urged toward a ratchet gear 17 by a spring 26 whose one end engages the feeding frame 7. The forwarding piece 20 makes the ratchet gear 17 forward tooth by tooth in association with a preventive function of the pawl 22 against gear's backward rotation, thereby moving up a lifter 16 formed in a united body with the ratchet gear 17.

The lifter 16 contacts a bottom of the sheet mounting plate 2 of the sheet cassette 1 to lift the sheet mounting plate 2, thereby moving up the sheets S mounted on the sheet mounting plate 2, and setting the topmost surface of the sheets at a constant level as to render the top surface of the sheets S in contact with the pickup roller 3.

Numeral 23 denotes a lifter trigger lever, which is supported as to be capable of rocking around the shaft 8 formed in a united body with the feeding frame 7. One end of the lifter trigger lever 23 is normally urged in a clockwise direction (arrow h direction in FIG. 2) with center of the shaft 8 by a spring 24 held at one end of a pickup lock lever 25 serving as a rocking restricting means as described below.

A restriction piece 23*a* as one end of the lifter trigger lever 23 is in contact with the lift-up cam 19 by pulling force of the spring 24. When contacted and engaged with an engagement portion 19*c* of the lift-up cam 19, as shown in FIG. 3(*a*), the restriction piece 23*a* of the lifter trigger lever 23 restricts rotation of the lift-up gear 18 formed in a united body with the lift-up cam 19. A contact piece 23*b*, the other end of the lifter trigger lever 23, is so placed as to contact with the pickup roller shaft 3*a* when the pickup roller 3 moves down to a prescribed level.

That is, when the pickup roller shaft 3*a* is lowered to the prescribed level, the contact piece 23*b* of the lifter trigger lever 23 is pulled down in opposition to the pulling force of the spring 24 to render the lifter trigger lever 23 move pivotally around the shaft 8 in the counterclockwise direction (arrow b direction in FIG. 3(*b*)), thereby disengaging the restriction piece 23*a* of the lifter trigger lever 23 from the engagement portion 19*c* of the lift-up cam 19 to release the restriction on rotation of the lift-up cam 19. The second cam 19*b* rotating together as a united body with the lift-up cam 19 contacts to a second cam contact portion 20*c* of the forwarding piece 20, thereby pushing the forwarding piece 20 around a shaft 21 in a clockwise direction (arrow c direction in FIG. 3(*b*)) to rock the forwarding piece 20. The ratchet gear 17 is moved up by this rocking motion of the forwarding piece 20 and elevates the lifter 16 as described below.

Elevation of the lifter 16 increases the sheet surface level of the topmost sheet S mounted on the sheet mounting plate 2, thereby moving up the pickup roller 3 that has contacted with the sheet surface. The contact piece 23*b* of the lifter trigger lever 23 moves up according to elevation of the pickup roller shaft 3*a*, thereby rotationally returning the lifter trigger lever 23 around the shaft 8 as a center in a clockwise direction (arrow h direction in FIG. 3(*a*)). The lifter trigger lever 23 thereby makes the restriction piece 23*a* of the lifter trigger lever 23 engaged and contacted with the engagement portion 19*c* of the lift-up cam 19 and returns to a position to restrict the rotation of the lift-up cam 19. This operation is repeated to render substantially the same the sheet surface level of the topmost sheet S mounted on the sheet mounting plate 2 of the sheet cassette 1.

As a result, the sheet feeding apparatus enters a standby mode that the sheets S can be conveyed. Subsequently, the pickup cam 10 rotates upon exciting the flapper solenoid 13 in association with a feeding start signal, and the lift-up lever 9 rotates in a counterclockwise direction (arrow m direction in FIG. 3(*b*)) in opposition to pulling force of the spring 9*a* around the shaft 8 as a center. As the contact piece 9*b* of the lift-up lever 9 moves down, the pickup roller shaft 3*a* goes down, thereby rendering the pickup roller 3 contact with the topmost sheet S on the sheet mounting plate 2 to feed out the topmost sheet S.

Though the sheet S located at the pickup roller 3 can receive an adequate conveyance force when the sheet surface level of the topmost sheet S is substantially the same, the conveyance force may be lowered and cause impairments of conveyance if the sheet surface level is lower than a suitable level.

The pickup roller 3 contacts the sheet surface of the sheets S for a time determined by the shape and angular velocity of the pickup cam 10, then, separates from the sheet surface, and moves up. A drive source not shown drives, for this period, the pickup roller 3, the feed roller 4, and the retard roller 5, respectively, as described above, thereby separating one by one the sheets S mounted on the sheet mounting plate 2 and feeding the separated sheet S.

In a meantime, when the sheet surface level of the sheets S is lowered, the contact piece 23*b* of the lifter trigger lever 23 is pulled down by the pickup roller shaft 3*a*, thereby moving pivotally the lifter trigger lever 23 in a counterclockwise direction (arrow b direction in FIG. 3(*b*)) in opposition to the pulling force of the spring 24 around the shaft 8 as a center. The restriction piece 23*a* of the lifter trigger lever 23 is disengaged from the engagement portion 19*c* of the lift-up cam 19 to release the restriction on rotation of the lift-up cam 19. The second cam 19*b* rotating together in a united body with the lift-up cam 19, therefore, comes to contact to the second cam contact portion 20*c* of the forwarding piece 20, thereby rotationally moving the forwarding piece 20 in arrow c direction shown in FIG. 3(*b*) around the shaft 21 as a center, and rendering a gear meshing portion 20*c* push up the ratchet gear 17 in arrow 1 direction in FIG. 3(*b*). Upon this pushing-up movement, the ratchet gear 17 moves up for one tooth. The lifter 16 moves up unitedly with the ratchet gear 17 and resumes the sheet surface level.

This operation is repeated to keep the sheet surface level substantially the same in the sheet cassette 1. The pickup roller 3, according to series of those operations, contacts to the sheet surface only when taking the sheets S out of the sheet cassette 1, and keeps away from the sheet surface for the remaining period. This motion of the pickup roller 3 maximizes prevention of double feeding of the sheets S by means of a pair of the feed roller 4 and the retard roller 5, thereby ensuring prevention of double feeding.

Lift-up operation of the lifter 16 will be described in detail. When the pickup cam 10 is rotated for one turn under a state shown in FIG. 3(*a*), a nail shaped portion 25*a* of the pickup lock lever 25 is engaged with a tip of the shaft contact piece 9*b* of the lift-up lever 9 as shown in FIG. 3(*b*).

When the pickup roller 3, or the pickup roller shaft 3*a*, moves down to the prescribed level, the lifter trigger lever 23 rotationally moves in arrow b direction around the shaft 8 as a center as shown in FIG. 3(*b*) to disengage the restriction piece 23*a* of the lifter trigger lever 23 from the engagement portion 19*c* of the lift-up cam 19, thereby releasing the restriction on rotation of the lift-up cam 19.

The lift-up cam 19 makes one turn unitedly with the lift-up gear 18 by meshing between the lift-up gear 18 and the gear 12. When the lift-up gear 19 rotates, the lifter mechanism starts lift-up operation as follows.

As described above, the first and second cams 19*a*, 19*b* are disposed coaxially with the lift-up cam 19. The first cam 19*a* is an eccentric cam and arranged as to be capable of contacting to the first cam contact portion 20*a* formed at the forwarding piece 20. The forwarding piece 20 is attached rotatably around the shaft 21 as a center; an attachment hole for the shaft 21 is a long hole. The forwarding piece 20 is attached as to be properly movable in arrow i direction in FIG. 3(*b*) and arrow j direction in FIG. 3(*a*).

Upon rotation of the lift-up cam 19, the first cam 19*a* rotates, thereby engaging and disengaging the ratchet gear 17 with and from the gear meshing portion 20*b* of the forwarding piece 20. The ratchet gear 17 does not normally mesh the gear meshing portion 20*b* of the forwarding piece 20 as shown in FIG. 3(*a*) when the lift-up operation is not needed. As shown in FIG. 3(*b*), upon rotation of the lift-up gear 18, the ratchet gear 17 comes to mesh the gear meshing portion 20*b* of the forwarding piece 20 in association with motion of the first cam 19*a*.

The forwarding piece 20 rocks in arrows c, k directions in FIG. 3(*b*) where the second cam 19*b* shown by a broken line in FIG. 3(*b*) and the second cam contact portion 20*c* of the forwarding piece 20 contact to each other, thereby lifting up the ratchet gear 17 in arrow 1 direction in FIG. 3(*b*). The pawl 22 disengages momentarily from the ratchet gear 17 since the ratchet gear 17 travels in arrow 1 direction in FIG. 3(*b*), and then, the pawl 22 meshes one tooth below of the ratchet gear by pulling force of the spring 26 whose one end is held to the feeding frame 7, thereby preventing the ratchet gear 17 from rotating further.

Finally, as shown in FIG. 3(*a*), when the nail shaped portion 25*a* of the pickup lock lever 25 is disengaged from the tip of the shaft contact piece 9*b* of the lift-up lever 9, the restriction piece 23*a* of the lifter trigger lever 23 restricts the rotation of the lift-up cam 19, disengaging the first cam 19*a* from the first cam contact portion 20*a*, thereby disengaging the gear meshing portion 20*b* of the forwarding piece 20 from the ratchet gear 17. Repeating this operation moves the lifter 16 up to a normal position.

A brief summary of series of this lift-up operation is as follows. First, the lift-up gear 18 rotates to engage the forwarding piece 20 with the ratchet gear 17 (see, arrow i in FIG. 3(*b*)) and then to elevate the ratchet gear 17 (see, arrows c, k, 1 in FIG. 3(*b*)). The pawl 22 meshes a tooth located at one tooth below, thereby disengaging the forwarding piece 20 from the ratchet gear 17 (see, arrow j in FIG. 3(*a*)).

Now, referring to FIGS. 4(*a*), 4(*b*), a lifter release operation will be described. As described above, the ratchet gear 17 normally engages only with the pawl 22, and if the sheet cassette 1 is pulled out of the image forming apparatus body A, a projection 40 formed at a rear portion of the sheet cassette 1 pushes a projection 22*a* of the pawl 22.

Figure 4:
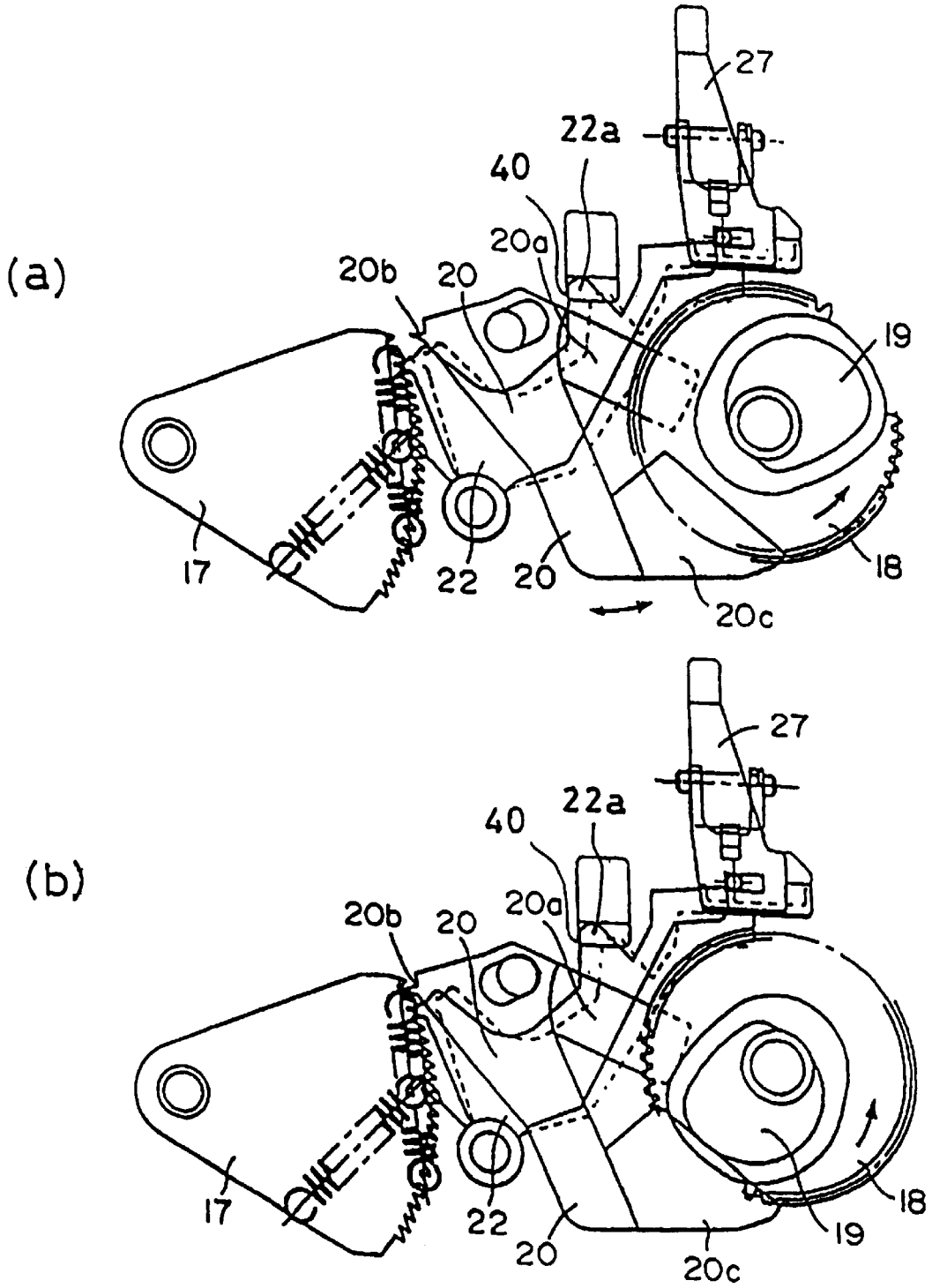
FIGS. 4(*a*), 4(*b*) are cross-sectional illustrations showing a release operation of the lifter when a cassette serving as a sheet containing means is attached.

The pawl 22 engages a cassette lock spring 27 and made immovable in a state shown in FIGS. 4(*a*), 4(*b*). Since no pawl engages the ratchet gear 17, the lifter 16 falls down according to weight of the lifter 16.

Figure 5:
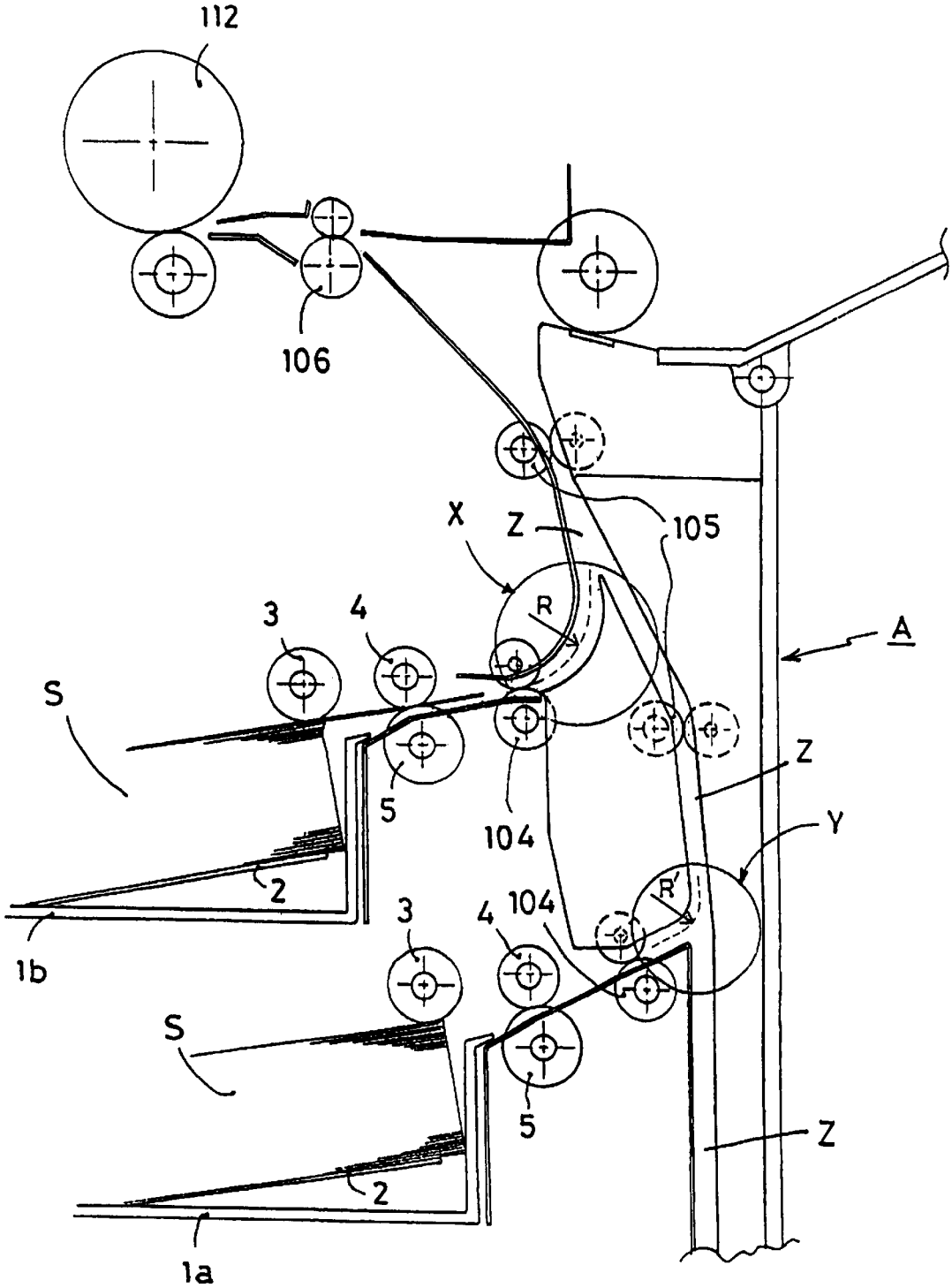
FIG. 5 is a cross-sectional illustration showing routes of different radiuses of curvature in the sheet feeding apparatus according to the invention.

Referring to FIG. 5, constitution of conveying routes of sheets S from the feeding section to the image forming section, as the essential structure of the invention, will be described. In FIG. 5, the sheets S contained in the upper cassette 1*b* of the sheet cassette 1 serving as a sheet containing means are separated one by one and fed by respective operations of the pickup roller 3, the feed roller 4, and the retard roller 5, which serve as the sheet feeding means, as described above. The separated sheet S is fed by the conveying roller 104 to pass the conveying path X as a conveying route, and then transferred to the common conveying route Z arranged linearly and vertically in the image forming apparatus A. The conveying roller 105 pulls up the sheet S and sends the sheet S to the register roller 106.

Similarly, the sheets S contained in the lower cassette 1*a* of the sheet cassette 1 are separated one by one and fed by respective operations of the pickup roller 3, the feed roller 4, and the retard roller 5, which serve as the sheet feeding means, as described above. The separated sheet S is fed by the conveying roller 104 to pass the conveying path Y as a conveying route, and then transferred to the common conveying route Z. The conveying roller 105 sends the sheet S to the register roller 106.

As shown in FIG. 5, the conveying path X has a radius of curvature R of 30 millimeters whereas the conveying path Y has a radius of curvature R' of 10 millimeters. The radius of curvature R of the conveying path X is designed to be relatively large as to be capable of conveying rigid sheets such as thick papers and special sheets such as envelops, whereas the radius of curvature R' of the conveying path Y is designed to be small as to be capable of conveying regular cut sheets that are ordinarily used.

The radius of curvature R (=30 millimeters) of the conveying path X is set twice larger or more of the radius of curvature R' (=10 millimeters) of the conveying path Y. In this embodiment, the radiuses of curvature R, R' are suitable respective amounts given through experiments.

It is to be noted that the conveying path X having the larger radius of curvature is located above the conveying path Y having the smaller radius of curvature. This is because the upper conveying path X, though having the larger radius of curvature, ensures a clearance where no other conveying path exists over the conveying path. In addition, if rigid sheets are conveyed through a longer route, paper jam possibility may increase, and therefore, it is beneficial to shorten the route from the tray or cassette to the image forming section. Moreover, the upper conveying path X is located closer to the conveying roller 105 in the common conveying route Z, thereby transferring the rigid sheets S at an early stage to the conveying roller 105. This apparatus has an advantage that such rigid sheets are further smoothly transferred through the curving portions upon using this conveying force in an ancillary fashion.

If inflexible sheets such as thick papers or special sheets such as envelops are to be subject to feeding operation where contained in a cassette connected to a conveying route having a curving portion of a small radius of curvature, those sheets S, though introduced into the conveying path Y by the pickup roller 3, the feed roller 4, and the conveying roller 5, may be jammed or delayed due to conveyance resistance incurred from the curving portion of the conveying path Y where the sheets S fail to follow the curving portion of the conveying path Y due to rigidity of the sheets S, and the sheets S may suffer from impairments of conveyance.

However, if such sheets S are transferred where contained in the upper cassette 1*b*, the sheets S reach the common conveying route Z by way of the conveying path X having the curving portion of the larger radius of curvature. Therefore, even though rigid the sheets S can pass the conveying path X easily, and the sheet feeding apparatus can transfer the sheets to the common conveying route Z and then to the register roller 106.

As described above, because the radius of curvature R of the curving portion of the conveying path X is designed to be larger than the radius of curvature R' of the curving portion of the conveying path Y, the apparatus can convey the sheets easily along the conveying routes forming the conveying paths even if the sheets are rigid sheets such as thick papers or special sheets such as envelops, and can convey the sheets without jam or delay of the sheets S under a low resistance at a time of the conveyance.

The apparatus having plural sheet containing means inside the image forming apparatus A, as described above, includes plural conveying paths generally constituted of U-turn paths as sheet conveying routes from the respective sheet feeding portions to the image forming section, in consideration of the structure of the apparatus.

With this embodiment, the radius of curvature of the curving portion of at least one conveying path among the plural conveying paths is arranged to be so larger as to be capable of conveying rigid sheets such as thick papers and special sheets such as envelops.

Thus, when images are to be formed on rigid sheets such as thick papers or special sheets such as envelops, users do not have to laboriously insert sheets one by one in a manual feeding slot as a conventional manner to implement a manual feeding, and the apparatus can automatically feed inflexible sheets such as thick papers or special sheets such as envelops upon containing the sheets in the regular sheet containing means, so that a stable feeding operation can be performed without jam or delay in a midway of the conveying routes.

In other words, when users perform image forming works on rigid sheets such as thick papers or special sheets such as envelops, the users do not have to laboriously insert sheets one by one in a manual feeding slot as a conventional manner, and the apparatus can automatically feed sheets upon containing the sheets in the regular sheet containing means, so that a stable feeding operation can be performed without jam or delay of sheets, thereby improving controllability of the apparatus.

It is to be noted that the upper cassette 1*b* described above can be a special cassette exclusive for containing special sheets such as envelops, or a cassette (adapter) for special sheets, not shown, may be optionally attached to feed sheets such as envelops, when such envelops are set in a regular cassette for regular papers.

Although in this embodiment, the image forming apparatus incorporating three sets of the conveying paths, in which each set has two conveying paths having different radiuses of curvature of the curving portions, is exemplified, various combinations of conveying paths are possible for the image forming apparatus, and, for example, the apparatus may have two sets, each set having conveying paths of three different radiuses of curvature.

What I claim is:

1. A sheet feeding apparatus, comprising:

a plurality of sheet containing means for containing sheets, the plurality of sheet containing means being disposed in a substantially aligned vertical direction, a topmost sheet containing means of said plurality of sheet containing means for containing sheets having a rigidity greater than a rigidity of sheets contained by all other sheet containing means of said plurality of sheet containing means;

a plurality of sheet feeding means for feeding the respective sheets contained in the plurality of sheet containing means, each of the plurality of sheet feeding means feeding the respective sheets in a same direction;

a vertically disposed common conveying route adjacent the plurality of sheet containing means; and a plurality of curving conveying routes for guiding the respective sheets fed by the plurality of sheet feeding means to the common conveying route, each of said plurality of curved conveying routes connected to the common conveying route at a distinct location, wherein a radius of curvature of the curving conveying route that conveys sheets fed from the topmost sheet containing means is larger than a radius of curvature of the curving conveying route of the other sheet containing means, whereby the topmost sheet containing means is capable of containing sheets of high rigidity.

2. The sheet feeding apparatus according to claim 1, wherein the radius of curvature of the first curing portion is twice larger or more than the radius of curvature of the second curving portion.

3. The sheet feeding apparatus according to claim 1, wherein the common conveying route extends vertically and linearly in an apparatus body, wherein straight portions of the conveying routes are placed perpendicularly with respect to the common conveying route, and wherein the conveying routes merge into the common conveying route via the curving portions of the conveying routes.

4. The sheet feeding apparatus according to claim 3, further comprising sheets of high rigidity in at least one of said sheet containing means, wherein said sheets of high rigidity are envelopes.

5. The sheet feeding apparatus according to claim 3, further comprising sheets of high rigidity in at least one of said sheet containing means, wherein said sheets of high rigidity are thick paper.

6. An image forming apparatus comprising a sheet feeding apparatus comprising:

a plurality of sheet containing means for containing sheets, the plurality of sheet containing means being disposed in a substantially aligned vertical direction, a topmost sheet containing means of said plurality of sheet containing means for containing sheets having a rigidity greater than a rigidity of sheets contained by all other sheet containing means of said plurality of sheet containing means;

a plurality of sheet feeding means for feeding the respective sheets contained in the plurality of sheet containing means, each of the plurality of sheet feeding means feeding the respective sheets in a same direction;

a vertically disposed common conveying route adjacent the plurality of sheet containing means; and a plurality of curving conveying routes for guiding the respective sheets fed by the plurality of sheet feeding means to the common conveying route, each of said plurality of curved conveying routes connected to the common conveying route at a distinct location, wherein a radius of curvature of the curving conveying route that conveys sheets fed from the topmost sheet containing means is larger than a radius of curvature of the curving conveying route of the other sheet containing means, whereby the topmost sheet containing means is capable of containing sheets of high rigidity; and an image forming means for forming images on the sheets fed from the sheet containing means.

7. The image forming apparatus according to claim 6, wherein the image forming means uses an electrophotographic method.

8. The sheet feeding apparatus according to claim 7, further comprising sheets of high rigidity in at least one of said sheet containing means, wherein said sheets of high rigidity are envelopes.

9. The sheet feeding apparatus according to claim 7, further comprising sheets of high rigidity in at least one of said sheet containing means, wherein said sheets of high rigidity are thick paper.

* * * * *

UNITED STATES PATENT AND TRADEMARK OFFICE

CERTIFICATE OF CORRECTION

PATENT NO. : 6,273,414 B1
DATED : August 14, 2001
INVENTOR(S) : Kazuhiro Matsuo

It is certified that error appears in the above-identified patent and that said Letters Patent is hereby corrected as shown below:

Column 2,
Line 43, "converted" should read -- converting --.

Column 5,
Line 32, "rocking" should read -- locking --.

Column 6,
Line 33, "a" should read -- the --.

Signed and Sealed this

Fifth Day of March, 2002

*Attest:*

*Attesting Officer*

JAMES E. ROGAN
*Director of the United States Patent and Trademark Office*